United States Patent [19]

Yanase

[11] Patent Number: 4,686,814

[45] Date of Patent: Aug. 18, 1987

[54] BAG FOR CONTAINING FLOWABLE FOODSTUFF

[75] Inventor: Shozaburo Yanase, Osaka, Japan

[73] Assignee: Yanase Waitch K.K., Osaka, Japan

[21] Appl. No.: 773,545

[22] Filed: Sep. 9, 1985

[30] Foreign Application Priority Data

Jun. 3, 1985 [JP] Japan ..... 60-83482[U]
Jun. 3, 1985 [JP] Japan ..... 60-83483[U]

[51] Int. Cl.[4] ..... B65B 43/32; B65B 7/10; B65D 33/20

[52] U.S. Cl. ..... 53/459; 53/468; 53/469; 53/482; 383/35; 383/36; 383/52; 383/89

[58] Field of Search ..... 53/468, 469, 482, 459, 53/492; 383/35, 36, 46, 52, 89, 33, 34, 82, 83, 85

[56] References Cited

U.S. PATENT DOCUMENTS 2,093,976 9/1937 Farmer ..... 383/89
3,149,771 9/1964 Pearl ..... 383/89
3,446,420 5/1969 Rinecker ..... 383/89
3,504,475 4/1970 Dickard et al. ..... 383/89 X
3,724,461 4/1973 Eisenberg ..... 383/35 X
4,467,588 8/1984 Carveth ..... 53/468 X
4,509,196 4/1985 Sak et al. ..... 383/89 X
4,584,201 4/1986 Boston ..... 383/89 X

FOREIGN PATENT DOCUMENTS 496974 10/1953 Canada ..... 383/35

*Primary Examiner*—Horace M. Culver
*Attorney, Agent, or Firm*—Oblon, Fisher, Spivak, McClelland & Maier

[57] ABSTRACT

A bag for containing flowable foodstuffs, made of a completely sealed laminated film, the bag having a reinforcing band attached thereto so as to ensure the opening operation made to one end of the bag for filling flowable foodstuffs to the inside and to facilitate the operation for expanding the opening, and having an adhesive band for enabling rapid, simple and reliable sealing for the bag after the flowable foodstuffs have been filled.

25 Claims, 23 Drawing Figures

BAG FOR CONTAINING FLOWABLE FOODSTUFF

FIELD OF THE INVENTION

This invention concerns a bag for containing flowable foodstuffs suitable to preservation under freezing or to portable use.

BACKGROUND OF THE INVENTION

Commercially available bags for containing foodstuffs are usually left open at their one ends. Accordingly, since external atmosphere invades to contaminate the inside of bags before they are used for preservation of foodstuffs, they are not suitable to the long time storage for foodstuffs. The present applicant has already filed patent applications concerning the subject for overcoming the foregoing drawbacks (refer to U.S. patent application Ser. No. 561,975 and Ser. No. 677,577 as a continuation-in-part application thereof). Further, the known bags are not yet quite satisfactory, because when the bag is stored while being laid laterally in a refrigerator or the like or carried about after it has been filled with foodstuffs through the upper opening and folded back the opening and then sealed at the folded-back portion with an adhesive tape or the like, the foodstuffs contained will bleed to leak through the folded portion at both longitudinal edges of the bag even when a tight sealing is applied there. Furthermore, the bag in the prior art has a drawback in that the operation for sealing the entrance of the bag after filled the flowable foodstuff is complicate and troublesome.

OBJECTS OF THE INVENTION

An object of this invention is to provide a bag for containing flowable foodstuffs, which is free from bleeding and leaking of the flowable foodstuffs from the inside of the bag after the bag have been filled with the foodstuffs and sealed.

Another object of this invention is to provide a bag for containing flowable foodstuffs capable of simply and reliably sealing the entrance of the bag after flowable foodstuffs has been charged to the inside of the bag.

A further object of this invention is to provide a bag for containing flowable foodstuffs in which the entrance of the bag can be simply cut out along a substantially linear path upon using the bag which is tightly closed before use.

A still further object of this invention is to provide a bag for containing flowable foodstuffs capable of simply and reliably maintaining the entrance of the bag upon filling flowable foodstuffs to the inside of the bag through the entrance once opened.

A still further object of this invention is to provide a bag capable of keeping the inside of the bag in a sterilized state before containing foodstuffs.

A yet further object of this invention is to provide a bag for containing flowable foodstuffs suitable to the long time storage and frozen storage of flowable foodstuffs in a refrigerator or the like, as well as to portable use for carrying about the bag.

SUMMARY OF THE INVENTION

This invention provide a bag made of a film sealed by welding for containing flowable foodstuffs comprising:

a notch provided on at least one longitudinal welded edge of the bag at a position in the vicinity of either one of the transversal edges of the bag, a reinforcing band attached to at least one surface of the bag in parallel with the transversal edge of the bag over the entire width in the transversal direction of the bag at a position inner from the notch with respect to the transversal edge in the vicinity of a position at which the notch is formed, and.

an adhesive band attached to at least one surface of the bag for reclosing the opened transversal edge of the bag in co-operation with the reinforcing band after the bag has been opened and the flowable foodstuffs have been filled to the inside thereof.

BRIEF DESCRIPTION OF THE DRAWINGS

The other objects and features as well as the foregoing objects and features of this invention will be understood more clearly by reading the descriptions for preferred embodiments thereof referring to the accompanying drawings, wherein.

DETAILED DESCRIPTION OF THE PRESENTLY PREFERRED EMBODIMENTS

Figure 1:
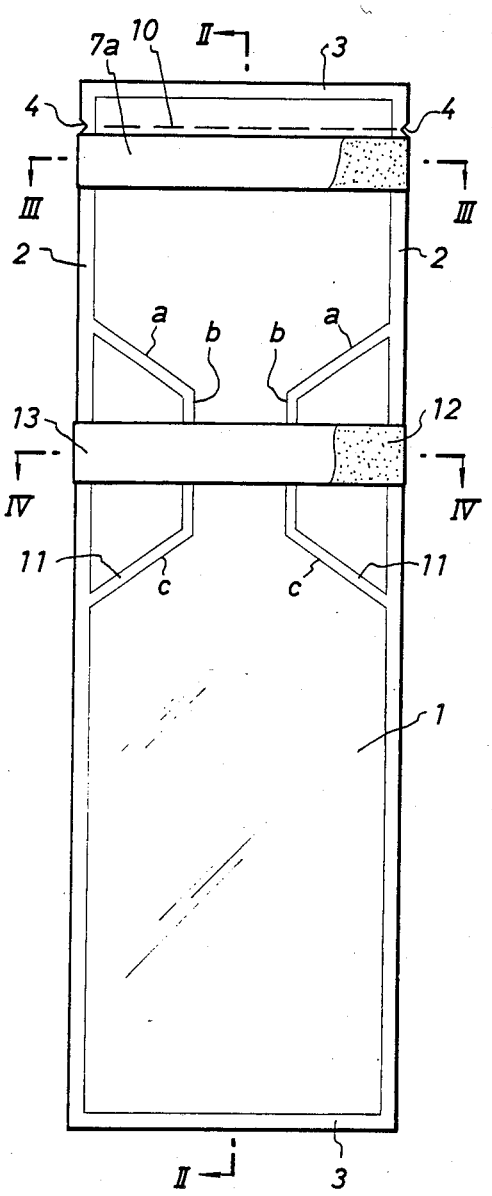
FIG. 1 is a front elevational view, partially in cross section, of one embodiment according to this invention.
Figure 2:
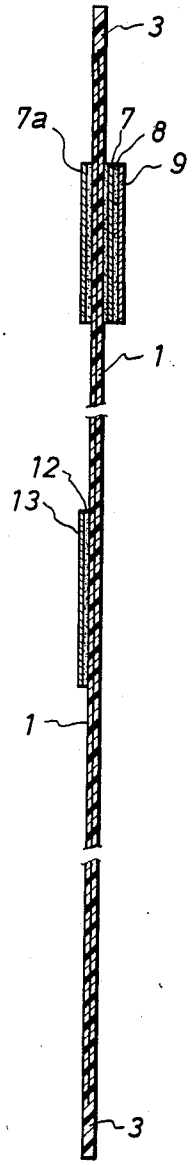
FIG. 2 is an enlarged cross sectional view taken along line II—II in FIG. 1.
Figure 3:
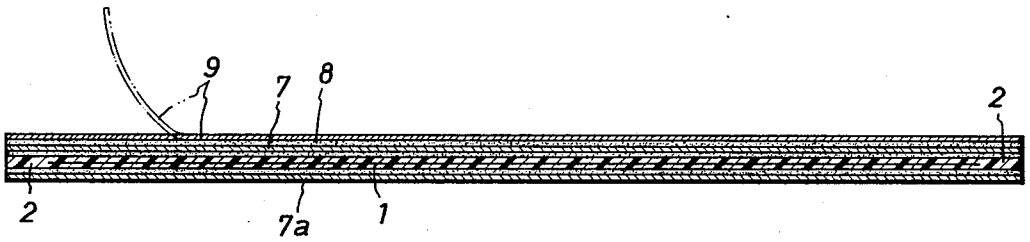
FIG. 3 is an enlarged cross sectional view taken along line III—III in FIG. 1.
Figure 4:
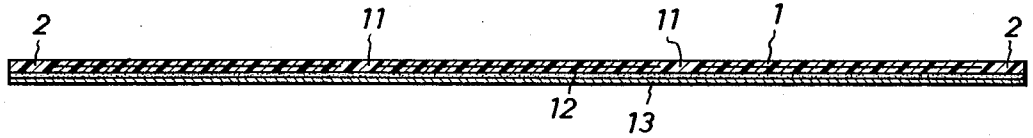
FIG. 4 is an enlarged cross sectional view taken along line IV—IV in FIG. 1.
Figure 5:
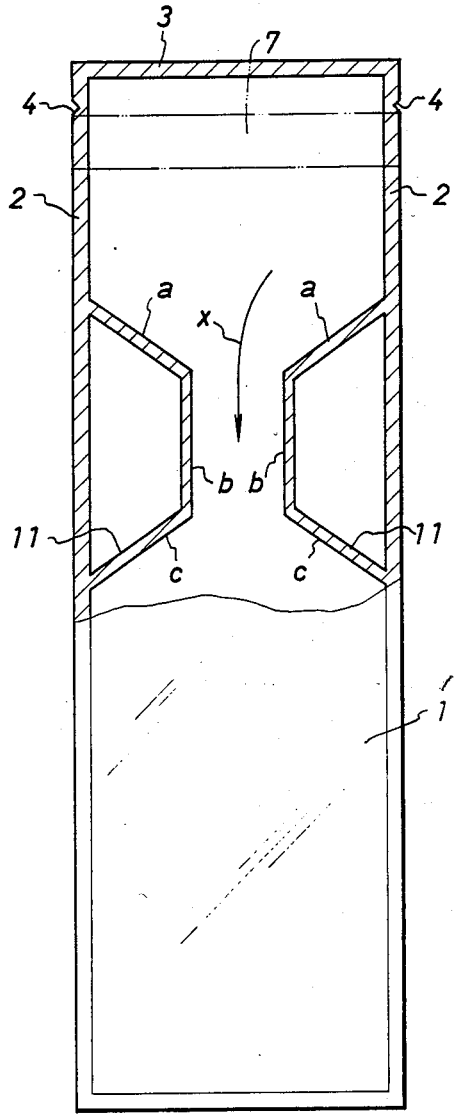
FIG. 5 is a front elevational view, partially in cross section, of a bag for one embodiment according to this invention in a state before the reinforcing band and the adhesive band of the bag are attached.

In FIGS. 1 through 11, a bag body 1 is made of a transparent laminated film comprising an inner layer composed of a thermoplastic resin such as polyethylene or the like and an outer layer composed of a thermoplastic resin such as nylon or the like. The bag body is prepared by heat-welding the circumferential periphery of two film sheets superposed and tightly sealed at the welded side edges 2 and 3. Alternatively, the bag body 1 may be formed by sealing two sides of an extruded tubular film by heat welding. A notch 4 is formed near the upper end of either one or both of the welded side edges 2 and an indication 10 showing a cut out position is printed on the bag body 1 extended from the notch 4 in parallel with the welded edge 3. Reinforcing bands 7, 7*a* are disposed on both surfaces of the bag body 1 at a position inside the indication 10, that is, at a position situated on the side of the bag main body when the sealing of the bag member is opened and substantially corresponding to the notch 4. Of the two reinforcing bands, the reinforcing band 7 comprises an adhesive member 8 and a releasable protecting sheet 9 attached thereover as shown in FIG. 3. The other reinforcing band 7*a* is made of a paper, synthetic resin or like other sheet and attached by way of a tear-resistant tape appended to the back thereof to the bag body 1. Alternatively, the reinforcing band 7*a* may be formed as a tape-like ridge integrally formed to the bag body 1. The other reinforcing band 7*a* may be ommitted depending on the case.

An adhesive band 12 is disposed at least on one surface of the bag body 1 below the reinforcing bands 7, 7*a*, and a releasable protecting sheet 13 is attached to the adhesive band 12. This adhesive band 12 is situated on one surface of the bag body 1 at such a position that when the entrance for the bag body 1 is cut out to open and the opening side of the bag body 1 is wound or folded back by several turns around the reinforcing bands 7, 7*a* as the winding core, the adhesive band corresponds to a wound core portion. Further, two weld lines 11, 11 are formed to both inner surfaces of the bag body 1 by way of heat welding and they comprise welded portions a, c which start from the positions which are symmetric with respect to the adhesive band 12 on the welded edge 2 and incline in the shape of funnel toward the adhesive band 12 and weld portions b, b which are continuous with the welded portions a, c and extend along the longitudinal direction of the bag body 1 to constitute a passage narrower than the width of the transversal edge of the bag body 1 at the position of the adhesive band 12.

Figure 6:
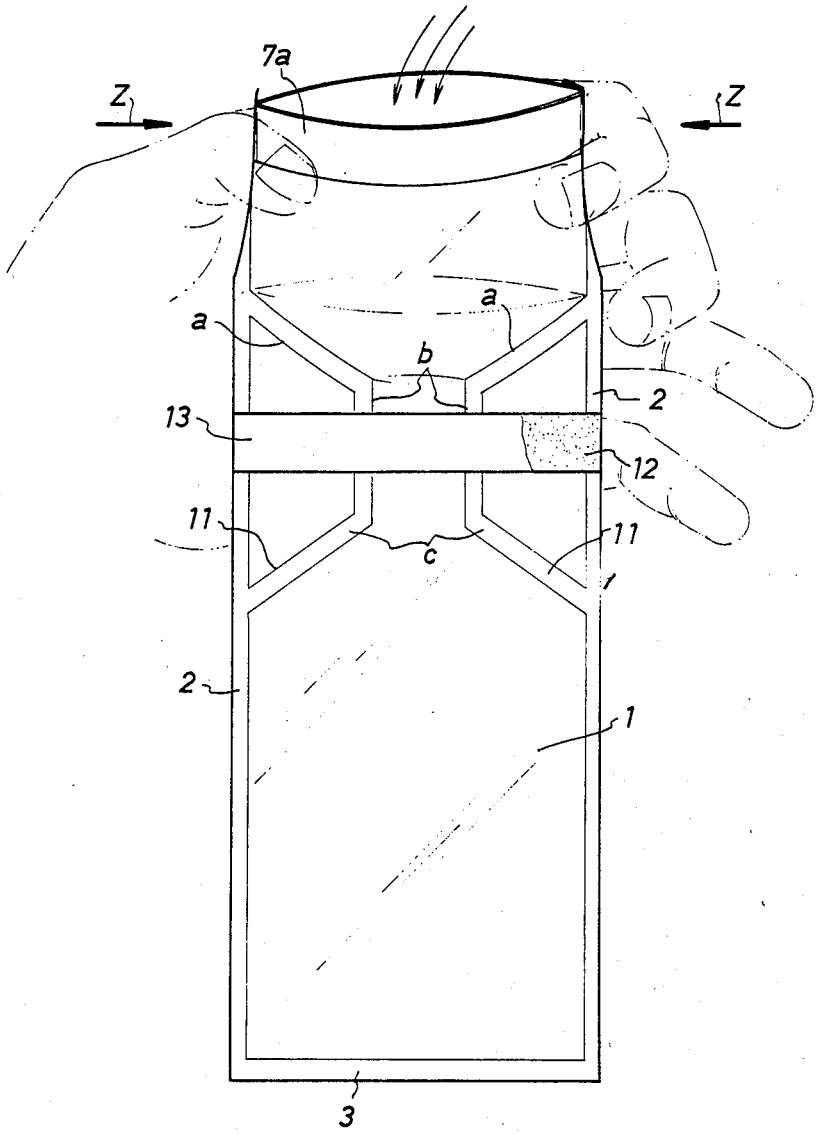
FIG. 6 is an explanatory view showing the state of the bag when it is opened and the reinforcing band is urged at both ends toward the longitudinal center thereof to expand the entrance of the bag.

In the bag of the illustrated embodiment, the sealed bag body is opened along the indication 10 by means of the notch 4. Since the reinforcing bands 7, 7*a* are formed to the end portion of the opening of the bag body 1 as shown in FIG. 6, the entrance of the bag body 1 is opened by urging the reinforcing band 7 at both ends toward the longitudinal center thereof, that is, in the direction of the arrow z shown in FIG. 6 to expand the entrance of the bag. Flowable foodstuffs such as milk, curry or soup are filled into the bag body 1 through the thus opened entrance. In this case, the reinforcing band 7 sufficiently serves to hold the bag body 1. Further, the welded portions a, a of the weld line 11 function as a funnel, through which the foodstuffs or the likes are introduced to the passage formed by the welded portions b, b and flown along the arrow x (refer to FIG. 5).

Figure 7:
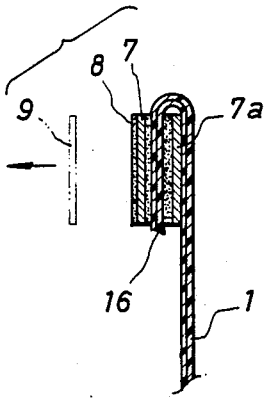
FIG. 7 through FIG. 10 are, respectively, enlarged cross sectional views for a portion of the bag taken along line II—II in FIG. 1 illustrating the sequence of folding back and sealing.
Figure 8:
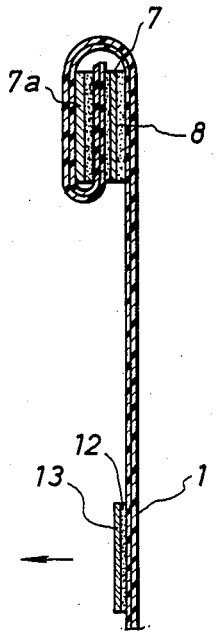
Figure 9:
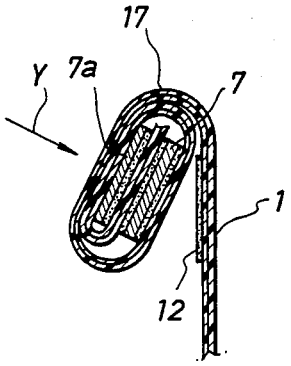
Figure 10:
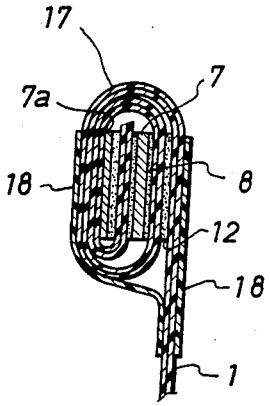
Figure 11:
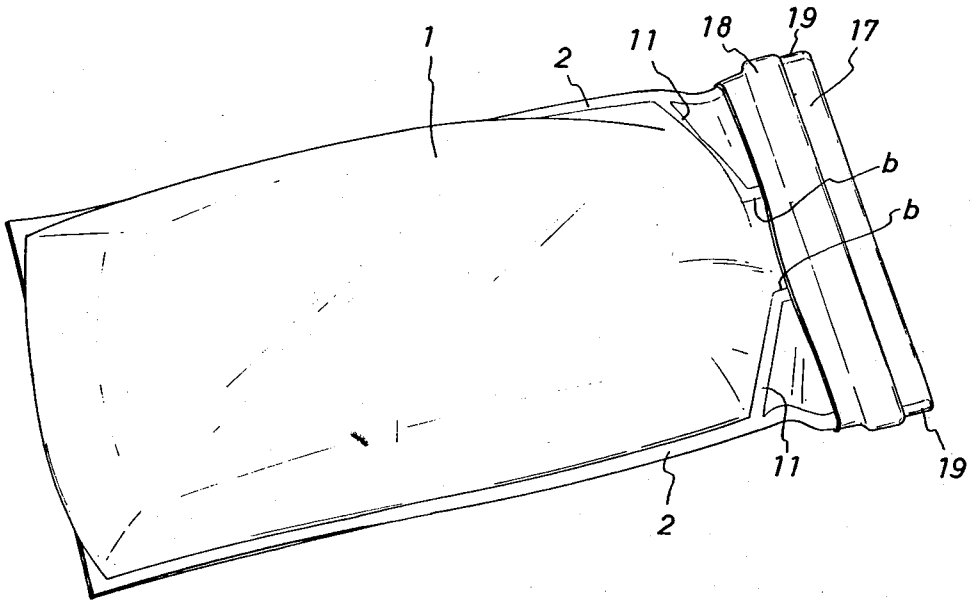
FIG. 11 is a perspective view showing the state where the filling of foodstuffs and folding back and sealing of the bag have been completed.
Figure 12:
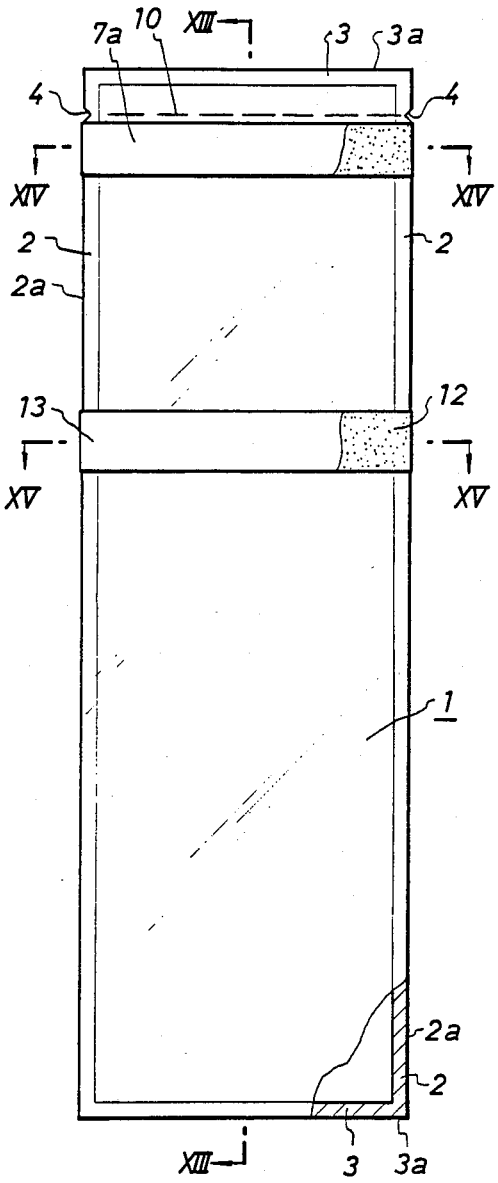
FIG. 12 is a front elevational view, partially in cross section, of another embodiment according to this invention.
Figure 13:
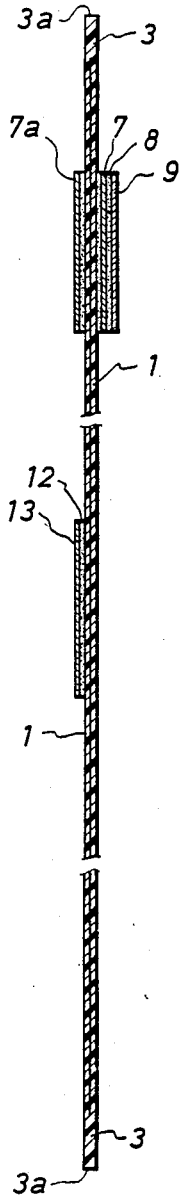
FIG. 13 is an enlarged cross sectional view taken along line XIII—XIII in FIG. 12.
Figure 14:
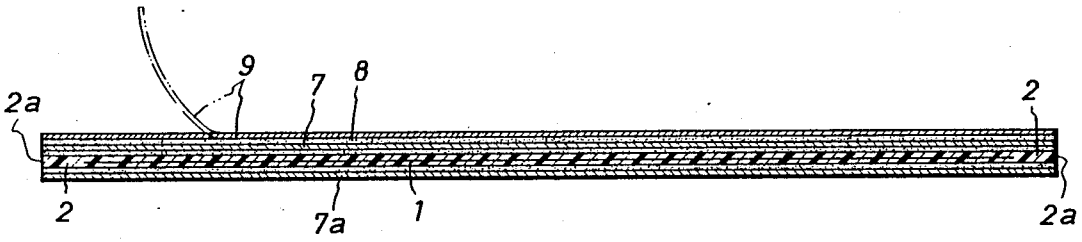
FIG. 14 is an enlarged cross sectional view taken along line XIV—XIV in FIG. 12.
Figure 15:
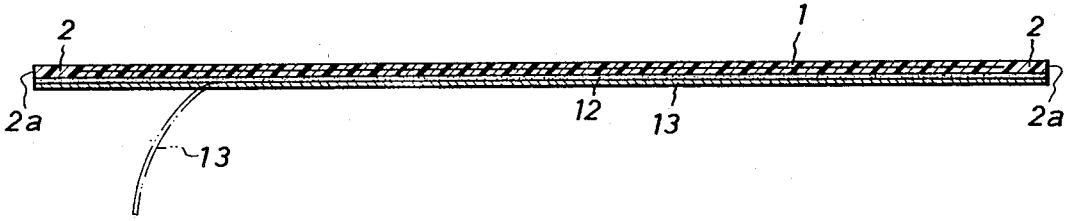
FIG. 15 is an enlarged cross sectional view taken along line XV—XV in FIG. 12.
Figure 16:
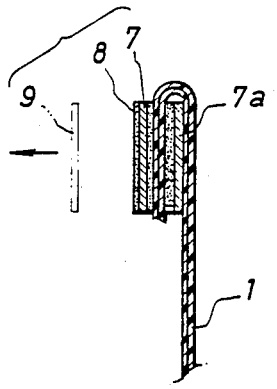
FIG. 16 through FIG. 19 are, respectively, enlarged cross sectional views for a portion of the bag taken along line XIII—XIII in FIG. 12 for illustrating the sequence of the folding and sealing the bag.
Figure 17:
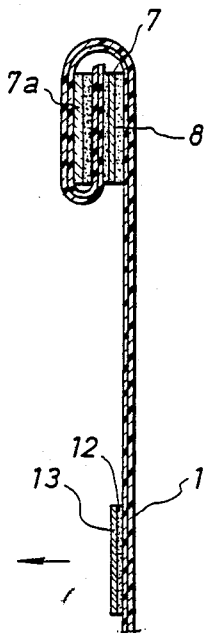
Figure 18:
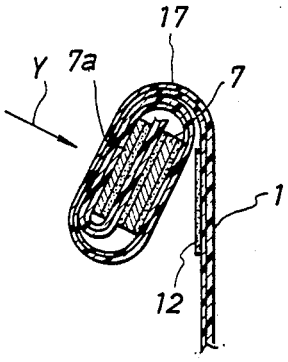
Figure 19:
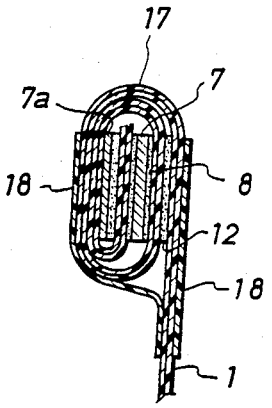
Figure 21:
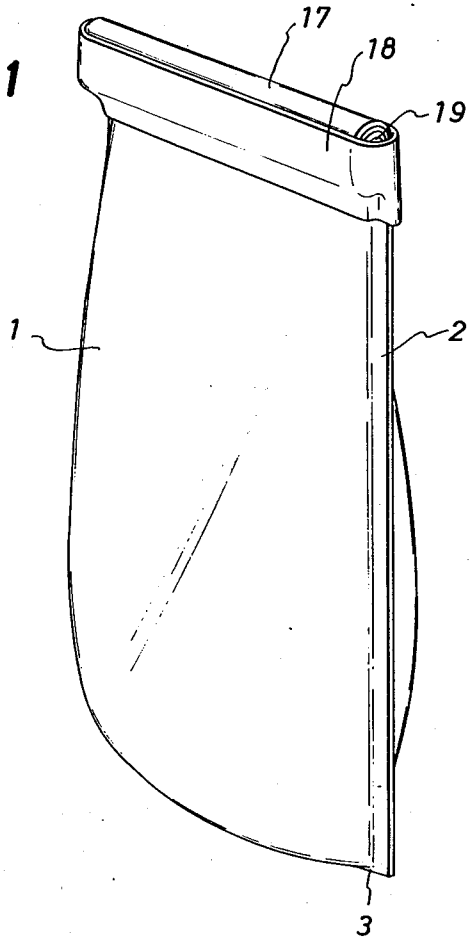
FIG. 21 is a perspective view illustrating the state where the filling, folding and sealing have been completed.
Figure 20:
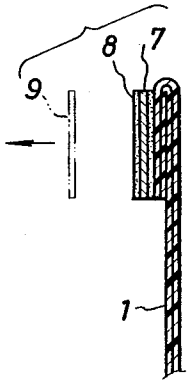
FIG. 20 is an enlarged cross sectional view for a portion of the bag taken along line XIII—XIII in FIG. 12 illustrating a portion where the folding and sealing are applied in which the reinforcing band 17*a* is omitted.

After the flowable foodstuffs have been filled, the entrance of the bag is wound or folded back around the reinforcing bands 7, 7*a* to form a wound portion 16 as shown in FIGS. 7 through 10. When the entrance is turned by once, the releasable protecting sheet 9 is released from the adhesive member 8 on the reinforcing band 7 situating now on the outerside as shown in FIG. 7 and the exposed adhesive member 8 is bonded tightly on the next turn to apply an adhesive sealing as shown in FIG. 8. On the third turn, the releasable protecting sheet 13 (shown in FIG. 9) situated at the position corresponding to the wound portion 17 upon third turning is released, and finally, the portion 17 is urged to the adhesive band 12 in the direction of the arrow y to apply a second sealing. The wound portion 16 is bonded to the bag body 1 by means of a separate adhesive tape 18, if necessary.

FIG. 12 through FIG. 21 show another embodiment according to this invention, in which the members or portions having the same functions as those in the foregoing embodiment carry the same reference numerals.

Figure 22:
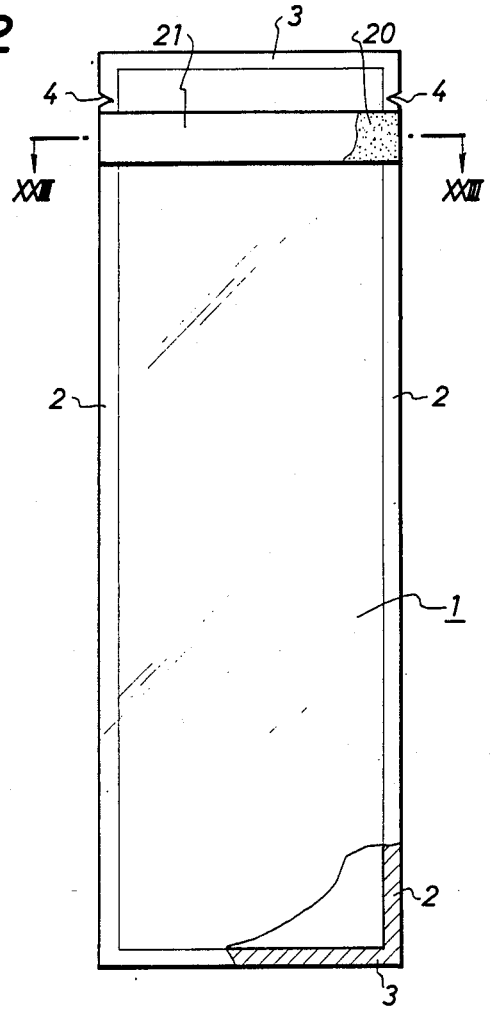
FIG. 22 is a front elevational view, partially in cross section, of a further embodiment according to this invention.
Figure 23:
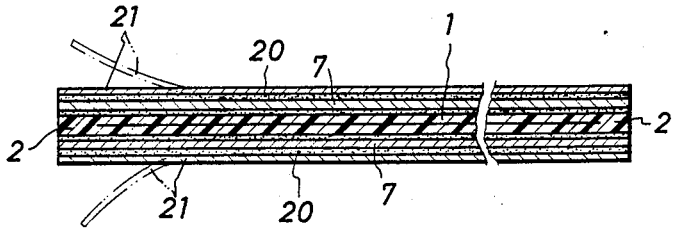
FIG. 23 is an enlarged cross sectional view taken along line XXIII—XXIII in FIG. 22.

The bag of this embodiment is used in the same procedures as described above. It may alternatively be adapted to have such a structure that the reinforcing band also functions as an adhesive band as shown in FIG. 22. In this case, after filling the flowable foodstuffs to the inside of the bag body 1 opened by means of the notch 4, the releasable protecting sheet 21 on one surface shown in FIG. 23 is at first released and then the bag body 1 is turned for once around the reinforcing and adhesive band 7 as the core thereby causing the adhesive surface 20 to be bonded onto the bag body 1. Then, the releasable protecting sheet 21 on the other surface is stripped and the bag body is turned further once thereby causing the adhesive surface 20 to be bonded to the bag body 1 to apply a sealing. Finally, in the same manner as the embodiment shown in FIG. 1 through FIG. 12, the wound portion is preferably bonded to the bag body 1 by means of a separate adhesive tape 1. It may alternatively be adapted, if required, such that the wound portion may further be wound for several turns after the second turning.

Since the bag for containing the flowable foodstuffs according to this invention having thus been constituted is formed as a flat shape sealed at the peripheral edges 2 and 3, it is quite free from contaminations caused by the intrusion of external air to the inside of the bag body 1 during storage before use. Further, the reinforcing bands 7, 7*a* can guide the cutting direction of the bag body 1 substantially linerly when it is cut out just before use to reliably form the entrance for filling. In addition, the bands can facilitate to form and maintain the entrance by being urged at both sides toward the longitudinal center thereof. Further, since the reinforcing bands 7, 7*a* comprise the adhesive member 8 attached to the releasable protecting sheet 9, they can form the wound portion 16 having them as the core after folding and bonding the cut out entrance to the bag body 1, thereby the bag body 1 can rapidly and easily be sealed. Furthermore, since the bag body 1 has the adhesive band 12 for bonding the wound portion 16 thereto, sealing for the entrance of the bag can be reinforced more reliably. Accordingly, the bag can effectively be used to the portable application for carrying about the bag, to a storage in a refrigerator or to a long time storage under cold or frozen state in a refrigerator or the like.

Among all, in the bag of the embodiment shown in FIG. 1 through FIG. 11, both inner surfaces of the bag body 1 are bonded with each other by applying the weld lines 11, 11 in the funnel-like shape comprising the welded portions a, c which slant from the positions in symmetrical with the adhesive band 12 toward the adhesive band 12 and the welded portions b, b which are continuous with the welded portions a, c and extended in the longitudinal direction of the bag body 1 to form a passage narrower than the width in the transversal direction of the bag body 1 at the position of the adhesive band 12. Therefore, both of the upper and lower portions of the weld line 11, 11 constitute the funnel-like configurations respectively, in which the upper funnel-like portion can surely guide the flowable foodstuffs when they are filled. The lower funnel-like portion seals the bag body 1 at the adhesive bond 12 disposed on the welded portion b so that, when the flowable foodstuffs filled in the bag are in a state where they are caused to flow back, the foodstuffs may concentrate between the welded portions b, b that form the central passage inside of the funnel-like slanted welded portions b, c. This can prevent the back flowing flowable foodstuffs from bleeding out of the welded positions b, b that form the narrow passage. Moreover, even in the case where the bag body 1 filled with the flowable foodstuffs is pressurized, the force acting to rewind the wound portion is restricted to that substantially corresponding to the width of the passage formed by the welded portions b, b and is smaller than that applied over the entire width in the transversal direction of the bag body. Further, the entire surface of the bag body for receiving the pressure under the pressurized state is defined with the slanted welded portion c and the welded portion b forming the passage, which is larger than the surface for the entire width in the transversal direction of the bag body. That is, back flow and bleeding of the flowable foodstuffs caused by the rewind of the wound portion can be reduced and disadvantages such as breaking of the bag body or the like can be prevented as much as possible.

In this way, in the bag for containing the flowable foodstuffs according to this invention, the flowable foodstuffs filled therein neither flow back nor bleed from the passage formed by the welded portions b, b, the both welded edges of the bag entrance and both corners of the wound portion 19 (refer to FIG. 11 and FIG. 21), as well as from other wound portion 17, until the seal is taken off and the entrance of the bag is released by rewinding the wound portion. Accordingly, this invention provides an advantage that the bag body, as it is filled with flowable foodstuffs and sealed, can be preserved in a refrigerator or the like while being laid laterally or can be carried about quite in the safe manner.

What is claimed is:

1. A bag made of a film sealed by welding for containing flowable foodstuffs, said bag comprising:

(a) a notch provided on at least one longitudinal welded edge of the body at a position adjacent to one of the transverse edges of the bag for tearing open the bag from said notch;

(b) reinforcing band attached to at least one surface of the bag in parallel with said one of the transverse edges over an entire width in a transverse direction of the bag for guiding the tearing of the bag along an edge of said reinforcing band through said notch, said reinforcing band being positioned adjacent to the position at which said notch is provided as well as positioned such that said notch situates between said reinforcing band and said one of transverse edges; and (c) an adhesive band attached to at least one surface of the bag for reclosing an opening formed by tearing the bag along the edge of said reinforcing band through said notch in cooperation with said reinforcing band after the bag has been opened and flowable foodstuffs have been placed in the bag, said adhesive band being positioned between said reinforcing band and the other one of said transverse edges of the bag.

2. The bag according to claim 1, in which said adhesive band is attached to at least one surface of the bag at a position substantially corresponding to two or more integer multiples of a width of said reinforcing band along a longitudinal direction of the bag from the position where said reinforcing band is attached.

3. The bag according to claim 1, in which said reinforcing band has a first adhesive member applied with a releasable protecting sheet.

4. The bag according to claim 1, in which said adhesive band comprises a second adhesive member having a releasable protecting sheet.

5. The bag according to claim 1, in which the width of said reinforcing band in the longitudinal direction of the bag is identical to that of said adhesive band.

6. The bag according to claim 1, in which a width of said adhesive band in the longitudinal direction of the bag is substantially twice or greater than that of said reinforcing band.

7. The bag according to claim 1, which comprises a sheet-like film sealed by welding a circumferential periphery of the film.

8. The bag according to claim 1, which is made of a tubular film molded by extrusion and sealed by welding edges in perpendicular to a direction in which the tubular film has been extruded.

9. A bag made of a film sealed by welding for containing flowable foodstuffs, said bag comprising:

(a) a notch provided on at least one longitudinal welded edge of the bag at a first position adjacent to one of the transverse edges of the bag for tearing open the bag from said notch;

(b) a reinforcing band attached to at least one surface of the bag in parallel with said one of the transverse edges over an entire width in a transverse direction of the bag for guiding the tearing of the bag along an edge of said reinforcing band through said notch, said reinforcing band being positioned adjacent to the first position at which said notch is provided as well as positioned such that said notch situates between said reinforcing band and said one of the transverse edges;

(c) an adhesive band attached to at least one surface of the bag for reclosing an opening formed by tearing the bag along the edge of said reinforcing band through said notch in cooperation with said reinforcing band after the bag has been opened and flowable foodstuffs have been placed in the bag, said adhesive band being positioned between said reinforcing band and the other one of the transverse edges of the bag; and (d) two welded portions formed in symmetry with a longitudinal center of the bag by partially welding both surfaces of the bag, each one of said two welded portions comprising two first welded portions extending from two second positions on a longitudinal edge, which are symmetrical with respect to said adhesive band, toward said adhesive band and a second welded portion longitudinally extending to intersect said two first welded portions, the two second welded portions on both sides of the longitudinal center forming a passage narrower than a width in the transverse direction of the bag at a third position of said adhesive band, an intersection of the second welded portion and one of the two first welded portions which extends from the second position lying between said reinforcing band and said adhesive band being positioned in a region between said reinforcing band and said adhesive band.

10. The bag according to claim 9, in which said adhesive band is attached to at least one surface of the bag at the third position substantially corresponding to two or more integer multiples of a width of said reinforcing band along a longitudinal direction of the bag from a position where said reinforcing band is attached.

11. The bag according to claim 9, in which said reinforcing band comprises a first adhesive member having a releasable protecting sheet.

12. The bag according to claim 9, in which said adhesive band comprises a second adhesive member having a releasable protecting sheet.

13. The bag according to claim 9, in which a width of said reinforcing band in the longitudinal direction of the bag is identical with that of said adhesive band.

14. The bag according to claim 9, in which a width of said adhesive band in the longitudinal direction of the bag is substantially twice or greater than that of said reinforcing band.

15. The bag according to claim 9, which comprises a sheet-like film sealed by welding a circumferential periphery of the film.

16. The bag according to claim 9, which is made of a tubular film molded by extrusion and sealed by welding edges in perpendicular to a direction in which the tubular film has been extruded.

17. A method of using a bag for containing flowable foodstuffs, said method comprising the steps of:

(a) cutting out one of the transverse edges of the bag by tearing the bag along a reinforcing band, which is provided on at least one surface of the bag in the vicinity of said one of the transverse edges of the bag, from a notch provided adjacent to said reinforcing band;

(b) filling flowable foodstuffs through a torn opening which is opened by compressing said reinforcing band from both longitudinal edges of the bag to bow said reinforcing band;

(c) then winding the bag around said reinforcing band as a core; and (d) bonding the thus wound portion to an adhesive band which is provided between said reinforcing band and the other one of the transverse edges of the bag, to thereby seal the bag, when the wound portion comes to a position where said adhesive band is provided.

18. The method according to claim 17, which comprises further bonding the wound portion bonded to said adhesive band to the bag by a separate adhesive tape.

19. A bag made of a film sealed by welding for containing flowable foodstuffs, said bag comprising:

(a) a notch provided on at least one longitudinal welded edge of the bag at a position adjacent to one of the transverse edges of the bag for tearing open the bag from said notch and (b) a reinforcing band attached to both surfaces of the bag in parallel with said one of the transverse edges over an entire width in a transverse direction of the bag for facilitating the opening of an opening formed by tearing the bag along an edge of said reinforcing band through said notch and for reclosing said opening, said reinforcing band being positioned adjacent to the position at which said notch is provided, said reinforcing band comprising a first band portion attached to one of said surfaces of the bag and a second band portion attached to the other one of said surfaces of the bag at a position which corresponds to the position where said first band portion is attached, said first and second band portions comprising an adhesive surface disposed respectively on outer surfaces thereof for effecting the reclosing of said opening.

20. The bag according to claim 19, in which each of said first and second band portions has a releasable protecting sheet on its adhesive surface.

21. The bag according to claim 19, which comprises a sheet-like film sealed by welding a circumferential periphery of the film.

22. The bag according to claim 19, which is made of a tubular film molded by extrusion and sealed by welding edges in perpendicular to a direction in which the tubular film has been extruded.

23. A method of using a bag for containing flowable foodstuffs, said method comprising the steps of:

(a) cutting out one of the transverse edges of the bag by tearing the bag along a reinforcing band which is provided on both surfaces of the bag in the vicinity of said one of the transverse edges of the bag, from a notch provided adjacent to said reinforcing band;

(b) filling flowable foodstuffs through a torn opening which is opened by compressing said reinforcing band from both longitudinal edges of the bag to bow said reinforcing band;

(c) winding once the bag around said reinforcing band as a core to thereby bond an adhesive surface disposed on an outer surface of said reinforcing band onto the bag; and (d) winding further once the bag around said reinforcing band as a core to bond an adhesive surface disposed on said reinforcing band onto the bag to thereby seal the bag.

24. The method according to claim 23, which comprises further bonding the wound portion to the bag by a separate adhesive tape.

25. A bag made of a film sealed by welding for containing flowable foodstuffs, said bag comprising:

(a) a notch provided on at least one longitudinal welded edge of the bag at a position adjacent to one of the transverse edges of the bag for tearing open the bag from said notch;

(b) a reinforcing band attached to at least one surface of the bag in parallel with said one of the transverse edges over an entire width in a transverse direction of the bag for guiding the tearing of the bag along an edge of said reinforcing band through said notch, said reinforcing band being positioned adjacent to the position at which said notch is provided as well as positioned such that said notch situates between said reinforcing band and said one of the transverse edges of the bag;

(c) an adhesive band attached to at least one surface of the bag for reclosing an opening formed by tearing the bag along the edge of said reinforcing band through said notch in cooperation with said reinforcing band after the bag has been opened and flowable foodstuffs have been placed in the bag, said adhesive band being positioned between said reinforcing band and said other one of the transverse edges of the bag; and (d) two welded portions formed by partially welding both surfaces of the bag, one of which projects from a first longitudinal edge of the bag to intersect an edge of said adhesive band which is opposite to said reinforcing band, the other one of which projects from a second longitudinal edge opposite to said first longitudinal edge to intersect said edge of said adhesive band without intersecting the other one of the two welded portions, the two welded portions forming a passage narrower than a width in the transverse direction of the bag at a position of said edge of said adhesive band therebetween.

* * * * *